United States Patent [19]

Dumenil et al.

[11] 4,170,846

[45] Oct. 16, 1979

[54] AUTOMATIC BASE SEAL

[76] Inventors: Claude G. Dumenil; Louis P. Dumenil, both of 4075, Route de Neufchâtel, 76230 Bois Guillaume, France

[21] Appl. No.: 813,076

[22] Filed: Jul. 5, 1977

[30] Foreign Application Priority Data

Jul. 7, 1976 [FR] France ..... 76 20773
Apr. 26, 1977 [FR] France ..... 77 12517

[51] Int. Cl.[2] ..... E06B 7/20
[52] U.S. Cl. ..... 49/303; 49/311
[58] Field of Search ..... 49/310, 311, 312, 313, 49/314, 303, 307; 248/224.1, 223.4, 224.2

[56] References Cited

U.S. PATENT DOCUMENTS

| | | | |
|---|---|---|---|
| 227,313 | 5/1880 | Stambaugh et al. | 49/311 |
| 227,404 | 5/1880 | Bell | 49/312 |
| 1,697,408 | 1/1929 | Thompson | 49/310 |
| 2,282,019 | 5/1942 | Balousek | 49/307 |
| 3,131,441 | 5/1964 | Cornell | 49/314 X |
| 3,263,366 | 8/1966 | Woloohojian et al. | 49/314 |
| 3,703,788 | 11/1972 | Rivers | 49/307 |
| 3,706,162 | 12/1972 | Werner | 49/310 X |
| 3,733,043 | 5/1973 | Binns et al. | 248/224.2 X |
| 3,871,133 | 3/1975 | Ellington, Jr. | 49/310 X |

*Primary Examiner*—Philip C. Kannan
*Attorney, Agent, or Firm*—Brisebois & Kruger

[57] ABSTRACT

An automatic base seal for a door where a deformable rod having an end fixed in a molding deforms transversely through a slot when its other free end is engaged by a door frame when the door is closed. The deformed portion of the rod displaces a seal against the threshold to seal the bottom of the door. Sides of a groove in the molding guide the deformed portion of the rod, and return springs maintain the seal retracted and adjacent the slot when the door is open. In one embodiment the seal pivots, and in another embodiment the seal moves vertically.

7 Claims, 8 Drawing Figures

AUTOMATIC BASE SEAL

SUMMARY OF THE INVENTION

The present invention relates to an automatic base or bottom seal having an external profile molding in the form of a drip cap or rain strip, without visible screws, designed to be fixed to the outside surface of a panel, particularly a door pivotable in a door frame, and comprising an elongated seal capable of being displaced between one position at least in part retracted in relation to the base and a sealed position extended in relation to its retracted position, under the action of a driving means actuated when the panel or door is closed.

Different types of base seals are already known, especially for door bottoms, containing a seal pivoting or displaced in translation under the effect of a driving mechanism. Such base seals generally contain a mechanism mounted in a groove of a molding or section attached to the door. From an aesthetic standpoint, one can cover up this molding by another molding which has the exterior shape of a drip cap, the fastening of this exterior molding being accomplished in general with the help of fastening means such as screws which remain visible after the mounting.

In addition, the known base seals are relatively cumbersome particularly in height, especially if one wishes to obtain a considerable lift or stroke of the sealing element.

The present invention provides an automatic base seal whose working does not change over a period of time, is of very slight height while assuring a considerable lift of the sealing element to offer a perfect seal when the panel is closed, and in the retracted position of the sealing element does not impede the displacement of the panel toward and in its open position.

The automatic base seal according to the invention comprises a molding strip receiving a driving means constituted by a deformable rod of which one extremity projects from one end of the molding, in the open position of the door, and of which the other extremity is fixed to the molding, the rod being pushed back axially in the molding by contact with an element of the door frame at the time of the closing of the door, and in deforming itself displaces an elongated section supporting the sealing element, characterized by the fact that the said deformable rod is lodged in an internal longitudinal groove and supports itself, by its extremity opposite to that projecting from one end of the molding, against a stop made in the said groove at a distance from the other end of the molding, the rod being guided between the walls of the said groove and projecting laterally out of the said groove through a slot between the ends of the groove along one part of its length when the door is closed and displacing the elongated sealing element by pressing against an elongated support section lodged in the said molding and carrying the sealing element.

In a first embodiment, in which the fastening on the panel or door is invisible, the molding presents an external form of a drip cap and contains at least two longitudinal internal grooves, the first receiving the deformable rod, and the second, receiving in a pivoting fashion the elongated support section of the sealing element which, in its retracted position in relation to the base seal, extends appreciably opposite and along the first groove.

The stop can be made to operate from the right or from the left to permit an easy and rapid reversibility of the device.

The rod can for example be made of flexible plastic material especially self-lubricating material such as a polyamide or polyoxymethylene.

A contact element is preferably provided at the end of the rod projecting from the molding and is preferably made in the form of a metal projection which can be provided with regulating means to provide for adjusting the length projecting from the end of the groove which receives the said rod. This groove for the rod has a section in the shape of a trough with parallel lateral walls. The stop formed in this groove can be constituted by an element which goes through the groove such as a rivet and to which one end of the rod can be fastened. As a variation this stop can be constituted by a cut and then turned-under wall of the groove.

The second of the said grooves which receives the sealing element in a pivoting fashion has an essentially slightly greater than semi-circular cross-section, the sealing element being able then to be carried by a flat support section whose one end has an essentially circular configuration corresponding to the cross-section of the groove, and whose other end is shaped in a fashion to receive the sealing element in the form of a flexible strip in a removable manner.

In a second embodiment the molding presents a cross-section in the form of an inverted U and contains near its top the internal longitudinal groove which receives the deformable rod, the deformation of the rod out of a slot in the groove causing a displacement in translation of the elongated support section and of the sealing element borne by it.

In an advantageous manner the deformable rod forming the driving means has for example an essentially circular or rectangular cross-section, the said groove being defined by the wall of the top of the molding, the adjacent areas of the lateral walls of the molding and two flanges projecting towards the interior of the molding from its lateral walls, the said flanges being interrupted or cut away near the central part of the molding so as to define a slot permitting the said rod to deform itself appreciably out of the said groove along one part of its length and to assure a displacement in translation, of considerable height of the elongated support section and of the sealing element borne by it.

As a variation, the upper part of the groove can be made by a flange joining the lateral walls of the molding.

The elongated seal support section is advantageously metallic and contains a longitudinal opening, for example of slightly greater than semi-circular cross-section, receiving a rib of corresponding cross-section of the sealing element.

The elongated support section is drawn back in the direction of the upper part of the molding containing the groove by springs which advantageously can be steel wire springs hooked by their extremities in openings made in the elongated seal support section, these wires being wound between their extremities in one of several coils on rods particularly cotter pins or hollow rivets permitting the passage of screws for the fastening of the base seal assembly to the door, the said rods projecting from a lateral wall of the molding inside of the molding with openings corresponding to these rods being made in the elongated seal support section.

Preferably, two identical springs are used, mounted in a fashion inversely symmetrical in relation to the central zone of the groove of the molding which permits the deformation of the rod held inside.

The elasticity of the springs permits an automatic adaptation of the inclination in relation to the ground of the sealing element and of its elongated support section. The openings made in this elongated support section offer the play necessary to permit the seal strip to tilt for automatic adaptation to the incline or slope of the threshold.

The present invention also has as its object as a new industrial product a sealing element capable especially of being used in the base seal according to this second embodiment, this sealing element presenting an upper rib or ridge of essentially circular cross-section to which are joined two divergent flanges or wings, themselves joined by an element in the shape of a V placed between the said divergent wings and extending between said wings or two V shaped members located between said wings and each having one end part connected to one of the wings, the other ends being in mutual engagement in the middle part of the sealing element. This sealing element is symmetrical in relation to a longitudinal plane and contains equally advantageously a flange extending perpendicularly to the plane of symmetry, to which the ridge of essentially circular cross-section is joined and from which the wings of the sealing element diverge. This sealing element is preferably made in a single piece of any appropriate material and for example of "elastomer," such as neoprene, flexible PVC or rubber.

With the aim of better understanding the invention, two embodiments will now be described purely as examples and in no way limiting.

Figure 1:
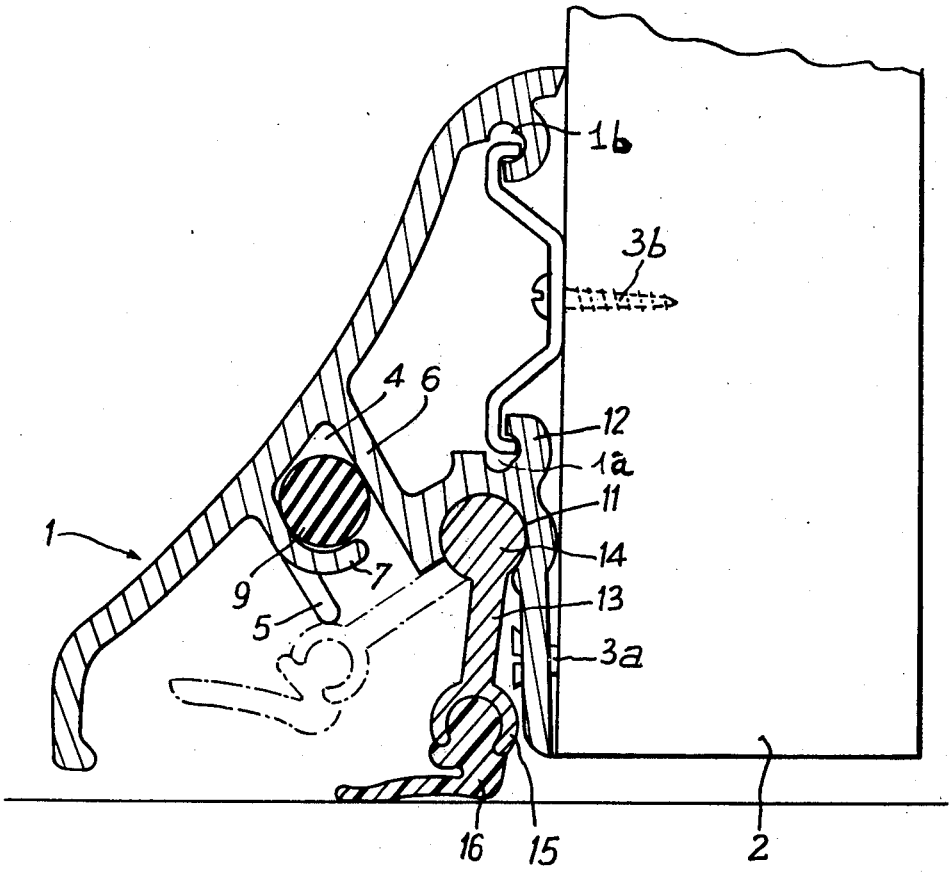
FIG. 1 is a view in section of the base seal according to a first embodiment of the invention, mounted on a panel.

The base seal according to the first embodiment of the invention is constituted by a molding section or extrusion 1 presenting an external shape of a drip cap. As can be seen in FIG. 1 this molding is fixed to the inner part of a movable panel, such as a door 2, by means of fastening elements such as screws 3*a*. It is of course possible to provide for other fastening elements for example in the form of guides mounted on panel 2 by screws 3*b* and engaging themselves in grooves of semi-circular cross-section 1*a* and 1*b* of molding strip 1. Notice that the fastening means of the molding strip on the door are invisible from the exterior, being concealed by the molding 1 itself.

Molding 1 contains an internal groove 4 having a cross-section in the shape of a trough with essentially parallel lateral walls 5 and 6. As can be better seen in FIG. 2 the lateral wall 5 is cut and turned under at spaced locations 7 and 8, walls 5 and 6 defining an opening or slot in the groove between parts 7 and 8. Inside groove 4 is placed a rod or strip 9, of self-lubricating deformable plastic material, for example of polyoxymethylene, the rod 9 containing at its extremity a metal tip or nipple 10 which can be seen in FIG. 2 projecting from the extremity of groove 4. Tip 10 is preferably provided with means for regulating or adjusting the action of the rod, for example in the form of a screw capable of being driven from the exterior to regulate the length of projection 10 and of the rod 9 projecting from the end of groove 4.

The turned under part 7 of the lateral wall 5 holds rod 9 inside groove 4, turned-under extremity 8 functioning as a stop which will be explained later, in the description of the operation of the base seal according to the invention.

Molding 1 contains a second groove 11 made in an extension 12 of wall 6, this groove 11 having an essentially slightly greater than semi-circular cross-section.

The base seal according to the first embodiment of the invention contains a flat rigid section 13 whose one extremity 14 has an essentially circular cross-section corresponding to the cross-section of the groove 11 so as to be able to pivot in this groove, the other extremity having a shape of a fork 15 capable of receiving a flexible seal strip 16, the strip being sufficiently inclined, for example at 45° in order to avoid being bent back when the door is closed. By pivoting in groove 11 the elongated support section 13 and the sealing strip 16 can occupy one sealing position, shown in solid lines in FIG. 1 and one retracted position, shown in phantom lines in FIG. 1. Return means, such as a spring, are advantageously provided to bring the sealing element 16 and its support section 13 back into their retracted position inside the base seal unit to the position shown in phantom lines in FIG. 1.

In this retracted position the support section 13 is found to extend across the opening between legs 5 and 6 of groove 4.

Figure 3:
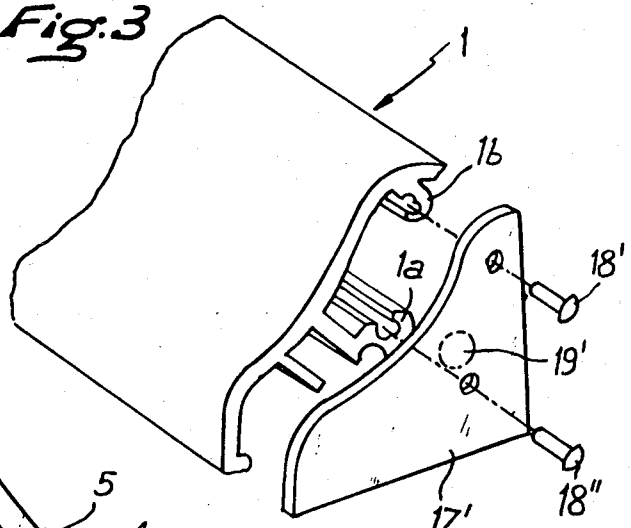
FIG. 3 is a partial view in perspective illustrating the mounting of an end cover.

One sees in FIG. 3 the mounting of an end cover 17' on molding 1, after the molding has been cut to the desired length. Mounting of cover 17' is achieved by rivets 18' engaging themselves in grooves 1*a* and 1*b*. The end cover from which nipple 10 projects contains a corresponding opening 19'.

The automatic base seal according to the first embodiment of the invention functions in the following manner:

In the position of opening the door the support section 13 and the sealing element 16 under the effect of the return means, are found in the retracted position shown in phantom lines in FIG. 1. Rod 9 is within groove 4. At the time of the closing of the door, nipple 10 integral with the end of rod 9 engages the vertical mounting of the door frame and is thus pushed back axially inside groove 4. Due to stopping means constituted by the turned-under part 8 or by any other convenient stop, for example a rivet passing through the groove 4 or an analogous element, rod 9 which is then held at one of its extremities by the stop element and which is pushed back at its other extremity by the action of nipple 10 against the element of the door frame deforms, but is guided in a plane between the lateral walls 5 and 6 of groove 4 and emerges or extends along its length, but intermediate its ends, from groove 4 as is shown in phantom lines in FIG. 2.

During this movement from and outside of groove 4 the deformed rod 9 engages and pushes back the support section 13 which is a position of rest opposite to groove 4, and makes section 13 pivot to the position shown in solid lines in FIG. 1, the strip 16 assuring then in the closed position of panel 2 its sealing function.

When the door 2 is opened again the force on nipple 10 ceases, rod 9 straightens and comes back to its position inside groove 4, and the support section 13, being no longer pushed back by rod 9, swings again under the influence of the return means towards the retracted position shown in phantom lines in FIG. 1.

Figure 2:
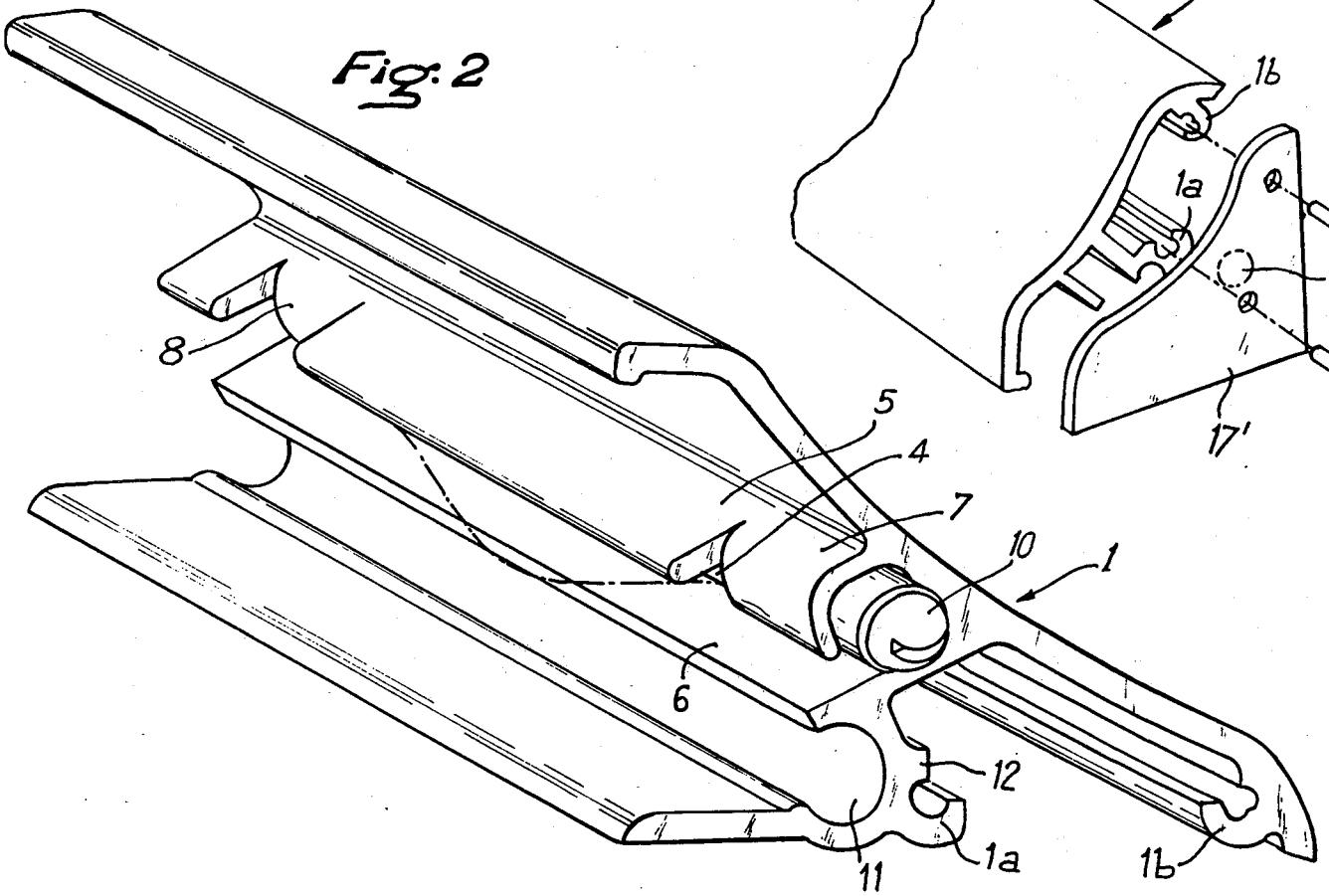
FIG. 2 is a partial view in perspective of one of the ends of the base seal according to FIG. 1.

The molding 1 of FIGS. 1–3, is preferably an extrusion of metal such as aluminum. The bent parts 7 and 8 can be formed by cutting wall 5 (after extrusion) and bending these parts to the shape shown so that rod 9 can slide through the part 7 whereas, part 8 presents a stop or abutment for the inner end of the rod.

As shown at FIG. 1, screws **3*b* secure a channel to one side of door 2. Molding 1 can be secured to the door by sliding it longitudinal onto the channel so inturned ends of channel engage in grooves 1*a* and 1*b* of the molding. Screws 3*a* can be used to prevent the molding 1** from moving longitudinally on the channel.

Refering to FIGS. 4 to 7, one sees that the base seal according to the second embodiment of the invention comprises a molding 17 of cross-section essentially of inverted "U" shaped configuration, containing near its back or upper wall, an essentially rectangular groove defined by the back wall 18 of the molding, the adjacent zones 19 of the side walls of the molding, and two flanges 20 projecting towards the interior of molding 17 from its side walls. The two flanges 20 are able to rejoin themselves in such a way as to form a continuous flange or intermediate wall joining the two vertical side walls of molding 17.

Figures 4, 5, 6, 7:
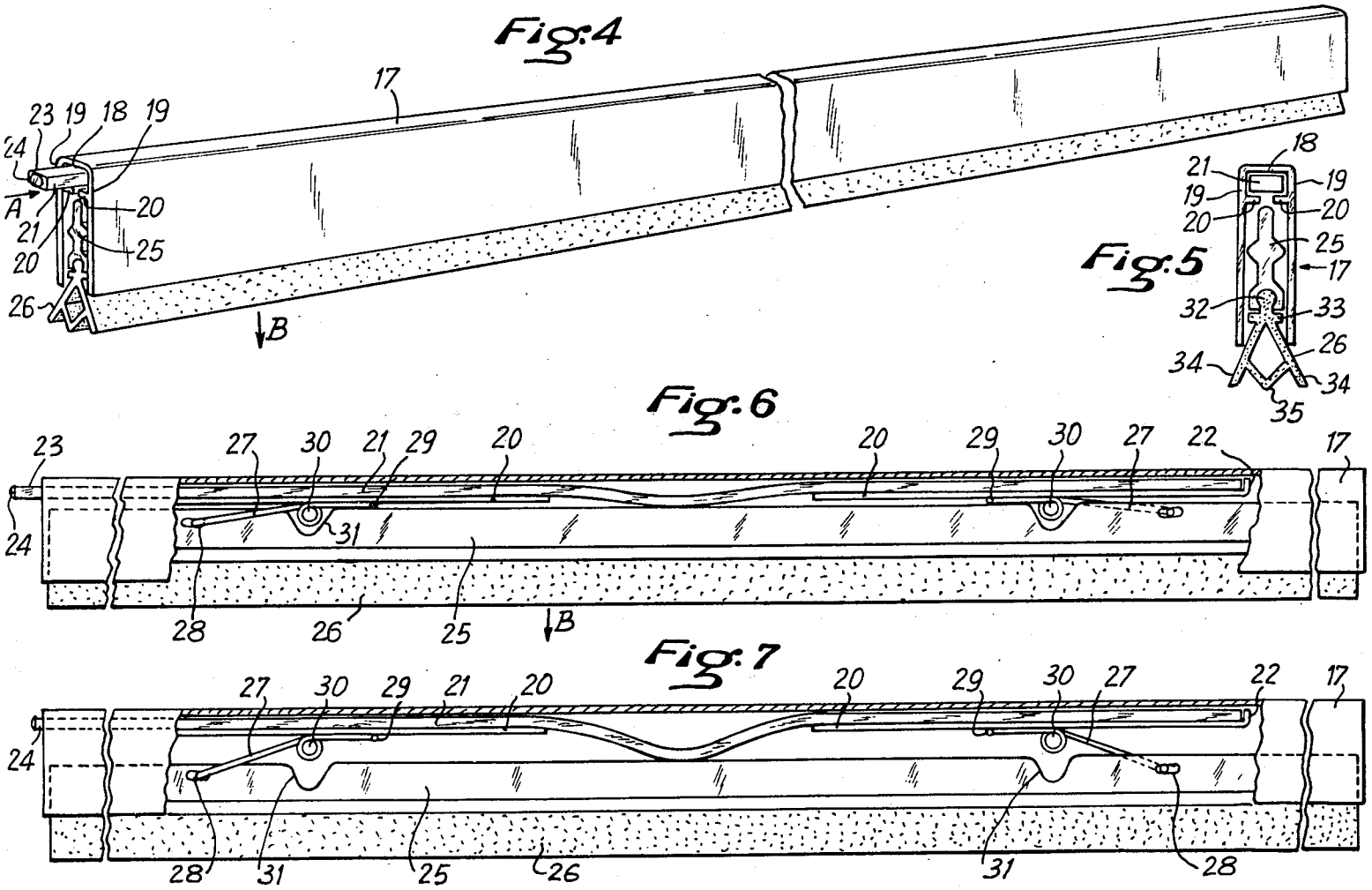
FIG. 4 is a pictorial view of the base seal according to a second embodiment of the invention.
FIG. 5 is an end view of the base seal of FIG. 4.
FIG. 6 is a view in elevation showing the base seal of FIG. 4 in which a flange of the molding forming the base seal has been cut away for more clarity, with the sealing element shown in a retracted position in relation to the base seal.
FIG. 7 is a view analogous to FIG. 6 with the sealing element shown extended in relation to the base seal.
Figure 8:
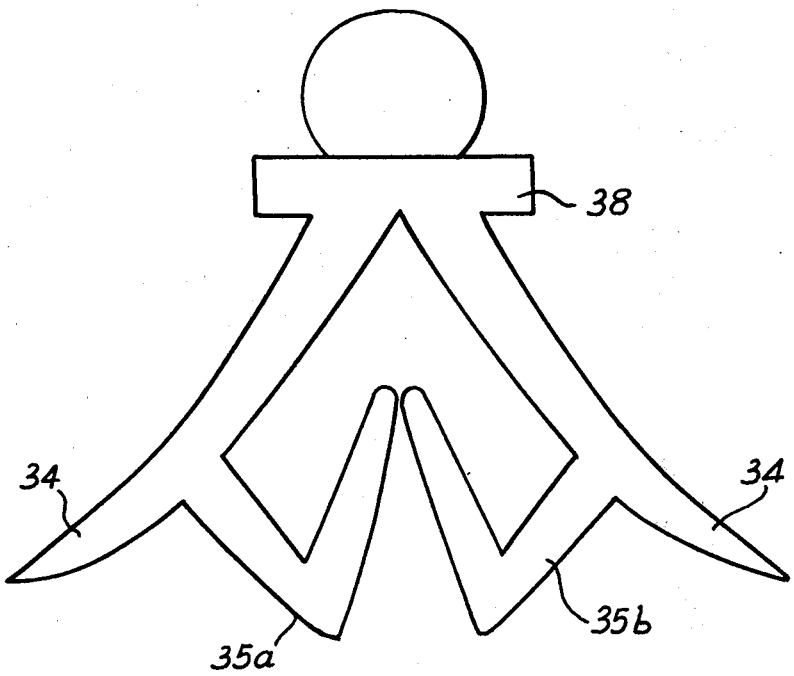
FIG. 8 is a view of another sealing element according to the invention.

As can be seen in FIGS. 6 and 7 these flanges 20 are broken or cut away near the central part of the base seal so as to form a slot to permit a deformable rod 21 within the groove to deform through the slot, when compressed axially. As can be also seen in FIGS. 6 and 7 these flanges 20 are bent up at 22 at one of their ends so as to make a stop for the deformable rod 21. Rod 21 has an essentially rectangular cross-section, of self-lubricating plastic material such as for example polyoxymethylene. This rod 21 extends into the groove defined between the wall 18, the adjacent parts of side walls 19 and flanges 20, and has, opposite to its end that is stopped against bent parts 22 of flanges 20, an exposed end 23 that extends axially from the groove.

At its extremity 23, rod 21 is advantageously provided with a metal nipple 24 which has an adjusting or regulating means such as a screw, to adjust the length of the rod projecting from the extremity of the groove which contains it.

Inside molding 17 is also placed a metal section 25 serving as a support for the sealing element 26.

The support section 25 is retracted toward the back wall 18 of profile 17 by springs 27 constituted by steel wire springs and hooked by their extremities in slots 28 made in the support section 25. By their ends 29, the springs support themselves against the lower surface of flanges 20. These wires are wound between their ends into several coils on rods, in particular split pins or hollow rivets 30 projecting from a lateral wall of the molding inside the molding. In addition, the support section 25 contains cuts 31 permitting it to engage around the rods 30.

The support section 25 has advantageously at its lower portion a longitudinal opening of slightly greater than semicircular cross-section receiving a ridge or rib 32 of corresponding cross-section of the sealing element 26.

This sealing element 26 contains in addition to the ridge 32, a flange 33 perpendicular to the plane of symmetry of the sealing element and to which are joined two divergent flanges or wings 34, themselves joined near their extremities by an element in the form of a V 35 whose point extends slightly below the ends of wings 34.

Although a sealing element presenting the characteristics shown in the drawing is particularly advantageous for the working of the base seal according to the second embodiment of the invention it should be understood that any appropriate type of sealing element can be used.

In another embodiment one can use a sealing member providing between the two diverging wings 34, two V shaped members **35*a*, 35*b*** located between said wings, each being connected by one end to one of the wings and with the other ends engaging one another in the medium plane of the sealing element.

The operation of the base seal according to the second embodiment of the invention will now be described.

It is implied, although it is not shown, that the base seal is placed at the lower part of a panel, for example of a door, the base seal being for example, recessed in the panel or integrated to a molding in the form of a rain strip or drip cap, notably clamped at the lower part of the panel, the mechanism of the base seal being able to be advantageously mounted into this drip cap molding by split pins. One thus obtains an aesthetic fastening without screws apparent, on the outside of the drip cap molding.

At the time of the closing of the panel, extremity 23 of rod 21 comes into contact with an element of the corresponding door-frame in such a manner that it exerts a force on the rod in the direction shown by arrow A in FIG. 4.

The rod is thus pushed back and as can be seen in FIG. 7 deforms itself out of the groove of molding 17 which holds it and pushes back by preventing movement of its other end. This causes translation of the center part of the rod 21 downwardly, (in the direction shown by arrows B in FIGS. 4 and 6), thus pushing the support section 25 and the sealing element 26 downwardly to the position of FIG. 7.

When one re-opens the door, no force is any longer exerted on extremity 23 of rod 21 so that the support section 25 and the sealing element 26 go back from their position shown in FIG. 7 to their position shown in FIG. 6 under the action of return springs 27. These springs permit a perfect guiding of the support means 25 at the time of its movement. In addition the particular arrangement of springs 11 permits the placing of the support section 25 as near as possible to the groove in which rod 20 is found, which permits the sealing element to retract itself to a considerable extent inside the section 17, in the open position of the panel. It is understood that the base seal according to the invention is reversible.

The molding 17 is preferably an extrusion of a weather resistant metal such as aluminum. The gap or slot through which rod 21 deforms is easily formed after extrusion by breaking away flanges 20 to the condition shown at FIGS. 6 and 7. Stops 22 can easily be formed by clipping or slitting a short section near the end of flanges 20 to enable bending these sections to form the stops.

Although the invention has been described in association with particular embodiments, it is very apparent that it is in no way limited by them and that numerous modifications can be made without going beyond either its scope or its spirit.

What is claimed is:

1. Automatic base seal for a panel comprising a molding containing a driving means constituted by a deformable rod whose one extremity projects from one extremity of the molding, in the open position of the panel, and whose other extremity is fixed to the molding, said rod being forced axially into the molding by contact with the door-frame element of said one end at the time of the closing of the panel, and in deforming itself displaces an elongated section supporting a sealing element, characterized by the fact that said deformable rod is disposed in an internal longitudinal groove of said molding and supports itself by its other extremity against a stop in said groove spaced from an opposite extremity of the molding, said rod being guided between walls of the said groove and projecting laterally out of the said groove through a slot formed in the groove along one part of its length when the panel is closed, said rod displacing the elongated sealing element by forcing out an elongated support section positioned in said molding and supporting the sealing element, said molding having an external profile in the form of a drip molding and having at least four internal longitudinal grooves, the first being the groove receiving the deformable rod, the second groove receiving for pivoting movement the elongated support section of the sealing element which, in its retracted position in relation to the base seal, extends across the first groove, and means for mounting said molding on the panel and comprising slide elements connected to the panel for engagement in the third and fourth grooves, said slide elements and third and fourth grooves providing an invisible mounting for said molding.

2. Automatic base seal according to claim 1, characterized by the fact that the first groove presents a cross-section in the form of a trough with essentially parallel lateral sides.

3. Automatic base seal according to claim 1, characterized by the fact that the said stop comprises a turned down wall of said first groove.

4. Automatic base seal according to claim 1, characterized by the fact that the said second groove presents an essentially semi-circular cross-section, the sealing element being supported by a flat strip whose one side presents an essentially circular cross-section corresponding to the cross-section of the second groove, and whose configuration at its other extremity is shaped to provide means to receive in a removable fashion a sealing element in the form of a flexible strip.

5. Automatic base seal according to claim 1, characterized by the fact that it contains end covers, fastened to said molding by rivets engaging themselves in the extremities of the internal grooves of the molding.

6. Automatic base seal according to claim 1, characterized by the fact that the said deformable rod is made of self-lubricating plastic material.

7. Automatic base seal according to claim 1, characterized by the fact that the extremity of the rod projecting from the groove presents a contact element in the form of a metal nipple provided with adjusting means for permitting the adjustment of the length of the rod projecting from the extremity of the groove which receives it.

* * * * *